US007942115B2

(12) United States Patent
Skulic

(10) Patent No.: US 7,942,115 B2
(45) Date of Patent: May 17, 2011

(54) SYSTEM FOR TRANSFORMATION OF RECTILINEAR MOTION INTO CURVILINEAR MOTION, OR VICE VERSA, PARTICULARLY FOR INTERNAL COMBUSTION ENGINE

(75) Inventor: Ivan Skulic, Lupoglav (HR)

(73) Assignees: Ivan Skulic, Lupoglav (HR); Bruno Abenavoli, Naples (IT)

( * ) Notice: Subject to any disclaimer, the term of this patent is extended or adjusted under 35 U.S.C. 154(b) by 631 days.

(21) Appl. No.: 11/736,826

(22) Filed: Apr. 18, 2007

(65) Prior Publication Data

US 2007/0199525 A1 Aug. 30, 2007

Related U.S. Application Data

(63) Continuation of application No. PCT/IT2005/000525, filed on Sep. 15, 2005.

(30) Foreign Application Priority Data

Nov. 26, 2004 (IT) ..... RM2004A0583

(51) Int. Cl.
*F02B 75/22* (2006.01)

(52) U.S. Cl. ..... 123/54.3; 123/55.3

(58) Field of Classification Search ..... 123/54.1–54.8, 123/55.3, 197.1, 56.1, 56.2, 56.7
See application file for complete search history.

(56) References Cited

U.S. PATENT DOCUMENTS

| | | | | |
|---|---|---|---|---|
| 2,120,657 | A | 6/1938 | Tucker | |
| 2,249,951 | A | 7/1941 | Fulton | |
| 3,841,279 | A | 10/1974 | Burns | |
| 4,149,498 | A * | 4/1979 | Ferrell | 123/56.7 |

FOREIGN PATENT DOCUMENTS

| | | | |
|---|---|---|---|
| DE | 654870 | C | 12/1937 |
| DE | 4344545 | A1 | 6/1995 |
| FR | 692293 | A | 11/1930 |
| GB | 457876 | A | 12/1936 |

* cited by examiner

*Primary Examiner* — Noah Kamen
(74) *Attorney, Agent, or Firm* — Gauthier & Connors LLP

(57) ABSTRACT

The invention relates to an improved system for transformation of rectilinear motion into curvilinear motion, or vice versa, in an internal combustion engine. The system comprising a rotor element and a stator element, one of said the rotor element and stator element having a closed spiral profile. The spiral profile having a continuous curvilinear portion for at least 270°, and a ramp portion joining the ends of the continuous curvilinear portion.

12 Claims, 5 Drawing Sheets

SYSTEM FOR TRANSFORMATION OF RECTILINEAR MOTION INTO CURVILINEAR MOTION, OR VICE VERSA, PARTICULARLY FOR INTERNAL COMBUSTION ENGINE

PRIORITY INFORMATION

This application is a continuation of International Patent Application No. PCT/IT05/000525, filed on Sep. 15, 2005, which designated the United States and claims priority to Italian Patent Application No. RM2004A000583 filed on Nov. 26, 2004, which is incorporated by reference in its entirety herein.

BACKGROUND OF THE INVENTION

1. Field of the Invention

The present invention relates to an improved system for transformation of rectilinear motion into curvilinear motion, or vice versa, particularly for internal combustion engine.

2. Brief Description of the Art

More specifically, the invention concerns a system of the above kind allowing obtaining the above mentioned transformation of the motion, optimising all the phases or strokes of an internal combustion engine, both for a two stroke engine and for a four stroke engine.

Obviously, the solution suggested can be used also for other kind of structures requiring the transformation of the motion.

Arrangement according to the invention is based on the principle providing the motion in an imaginary point of a Archimedean polar spiral, which, when stressed by an outer force, moves in a direction opposite to the direction of the force acting on the same. Imagining that said an arm to the centre of the spiral connects point; a curvilinear continuous motion is obtained until the application of the outer force is interrupted.

The system according to the invention, realised on the basis of the above-mentioned principle, in function of the direction of the force acting from outside with respect to the spiral, or the direction of the force acting from inside with respect to the spiral, can be realised according to different constructive modes.

SUMMARY OF THE INVENTION

Improved system for transformation of rectilinear motion into curvilinear motion, or vice versa, particularly for internal combustion engine, the system comprising a rotor element and a stator element, one of the rotor element and stator element having a closed spiral profile, the spiral profile having a continuous curvilinear portion for at least 270°, and a ramp portion joining the ends of the continuous curvilinear portion, wherein the continuous curvilinear portion extends for about 340°-345° for four-stroke engine and for about 350°-355° for two stroke engines.

Preferably, according to the invention the continuous curvilinear portion extends for about 300°, preferably for about 340°-345° for four-stroke engines and for about 350°-355° for two-stroke engines.

Always according to the invention, the profile can be realised on the outer surface and/or on the inner surface of the rotor element.

Still according to the invention, the profile can also be provided on the upper surface and/or lower surface of the rotor.

According to the invention, a sliding or rolling means can operate, with the lowest possible friction, coupled at the end of the rod of a piston, the piston acting within a cylinder.

Preferably, according to the invention, a plurality of sliding or rolling means-piston-cylinder assemblies can act on the rotor element.

Furthermore, according to the invention, a plurality of rotors, parallel each other, can be provided.

Still according to the invention, the rotor can be provided inside a cylinder-supporting block, i.e. outside a cylinder-supporting block.

Always according to the invention, the sliding or rolling means-piston-cylinder assemblies can be provided either inside or outside.

By the solution suggested according to the present invention the following advantages are obtained:

- apart from the number of cylinders provided for a single spiral-shaped rotor-disc, only one of them, for a reduced rotor rotation angle, is in the compression stroke, while all the others are in an expansion stroke (active);
- during a single active stroke (combustion/expansion), the piston "pushes" the rotor to make an almost complete revolution, i.e. 360° minus 20° of the complete revolution; with the consequent saving of fuel. In the traditional internal combustion engines, piston during the active stroke acts with a motive energy useful only to make half revolution of the output shaft, while the other half of the output engine revolution is used for the stroke of the piston toward the Top Dead End (TDE), i.e. for the compression phase;
- the compression phase occurs along an angle included between the minimum distance ray from the rotation centre and the maximum distance ray from the rotation centre, angle comprising the ascent joining the two rays and occupies between about 10° and 15° of the circumference, only as a function of inclination angle of the ascent (a less sleep ascent promotes the stroke of the piston towards the T.D.E., and thus an easier compression, with a lower resistance of the cylinder and of the piston rod, and at the same time prolongs only the compression phase, occupying a bigger angle between the two rays, and vice versa;
- adjusting the inclination of the cylinders with respect to the rotor it is possible obtaining an adjustable stroke of the pistons in function of the specific features that are wished for the operating engine;
- a remarkable reduction of the mass employed is possible.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE INVENTION

Preliminarily, it must be noted that the system according to the invention provides a spiral profile, preferably an Archimedean spiral profile, with a portion of the profile, that can vary on the basis of the specific needing, but in any case not lower than 270°, for the expansion phase of the engine, while a very limited portion of the profile, even only 2°, is destined to the other phases of the engine cycle. In line of principle, it will be of about 6-10° for a two-stroke engine and of about 12-20° for a four-stroke engine.

Figure 1:
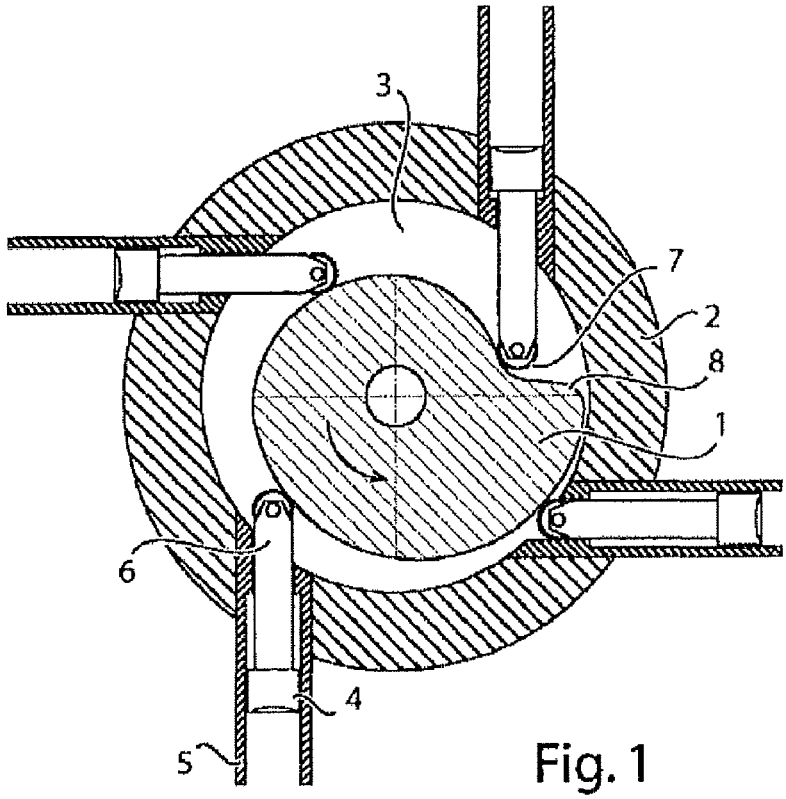
FIG. 1 schematically shows a cross-section of a first embodiment of an engine according to the invention.
Figure 2:
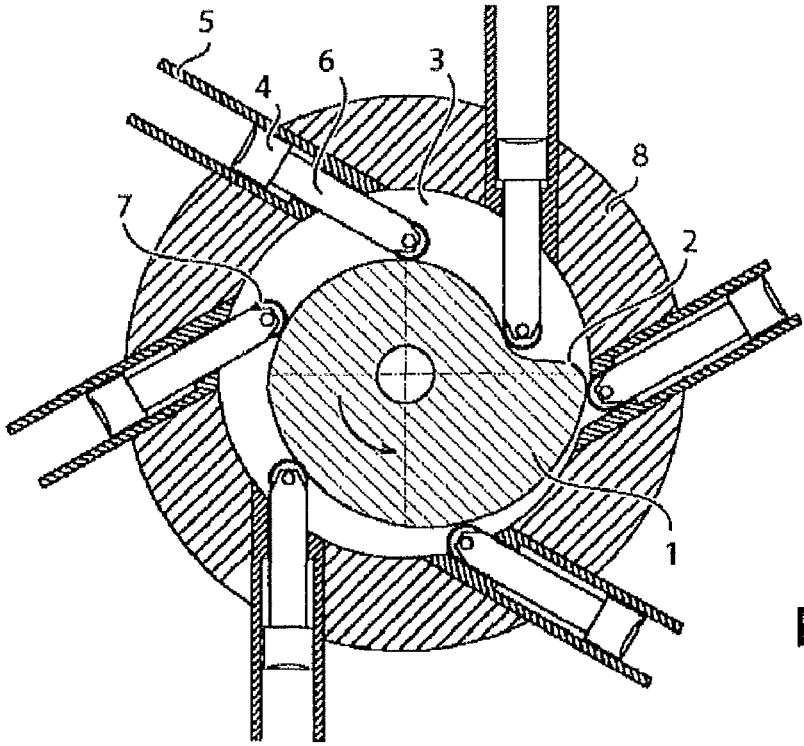
FIG. 2 schematically shows a cross-section of a second embodiment of an engine according to the invention.

Observing first FIGS. 1 and 2 of the enclosed drawings, an embodiment of the engine according to the invention is shown, providing an inner rotor disc 1 having a spiral shaped curve, positioned inside the cylinder supporting block 2.

The cylinder supporting block 2 has an inner circular shape, and it is concentric with respect to the rotation axis of the rotor disc 1.

Curve space obtained between disc 1 and block 2 is the expansion space for the piston (pistons) 4.

Each cylinder 5, with the piston 4, rod 6 and wheel 7, is mounted with an inclination angle optimum with respect to the curvilinear shape of rotor 1, and in such a way that the corresponding wheel 7 always is in contact with the disc 1.

Examining the shaped profile of rotor disc 1, ascent-ramp 8 of the spiral shaped curve, or compression ramp, is that part of the rotor curve 1 along which the compression of piston 4 occurs, and at the beginning of the ramp 8 the Bottom Dead Centre (B.D.C.) is provided.

Embodiment shown in FIG. 1 provides four cylinders 5-piston 4, while embodiment of FIG. 2 provides six groups.

Figure 3:
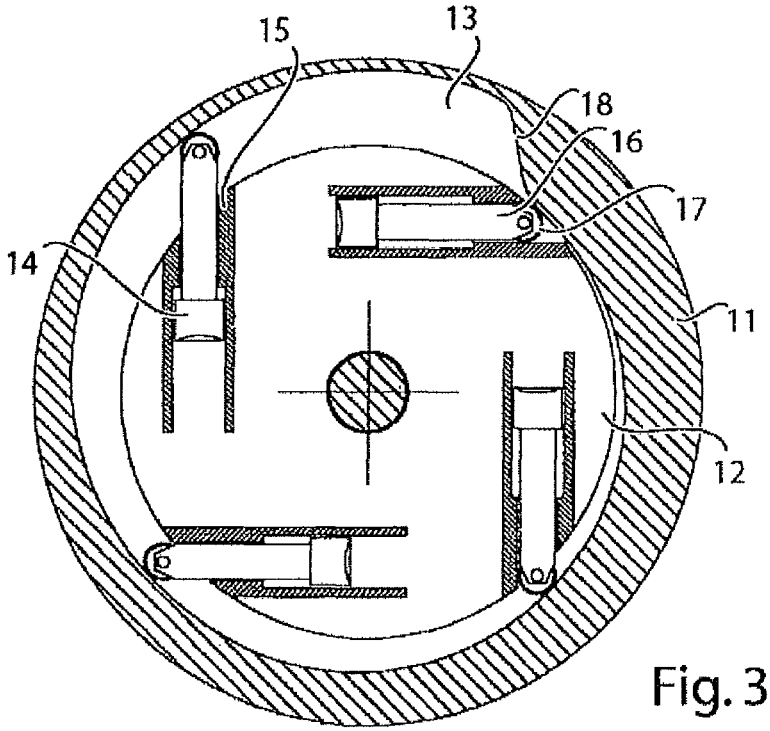
FIG. 3 schematically shows a cross-section of a third embodiment of an engine according to the invention.
Figure 4:
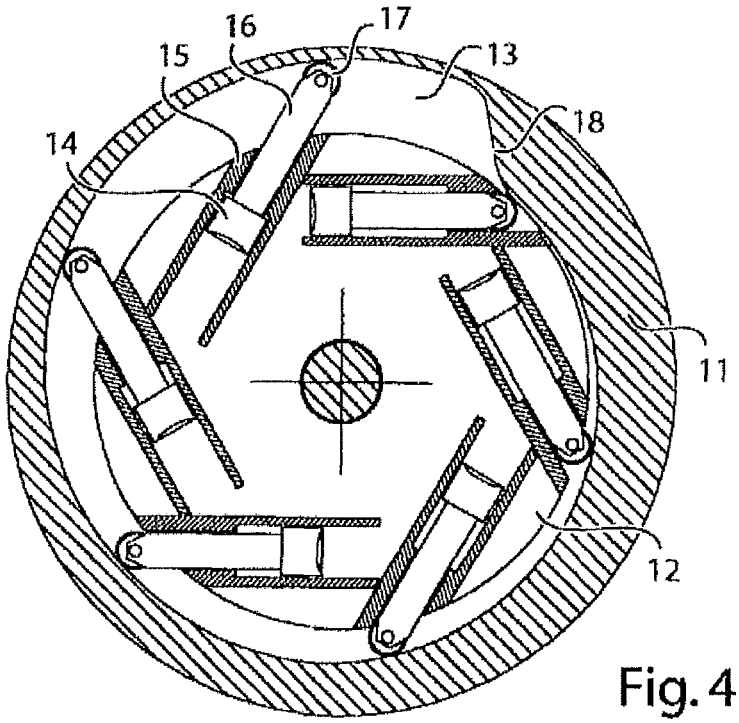
FIG. 4 schematically shows a cross-section of a fourth embodiment of an engine according to the invention.

Coming now to observe FIGS. 3 and 4 of the enclosed drawings, two further embodiments of the engine according to the invention are shown, providing an outer rotor disc 11, the rotor disc having an outer cylindrical shape and an inner spiral shaped curve. In this case, cylinder-supporting block 12 is concentrically inserted within the rotor 11.

Notwithstanding all the other features of the embodiments shown in FIGS. 3 and 4 are the same of the embodiments of FIGS. 1 and 2, the solution with rotor disc 11 outside the block 12 is use in case it is required a structure with a rotor 11 faced outside, such as for electric engines, electric generators, etc.

Each one of the solutions shown in FIGS. 1-4 is of the multi-cylinder type.

Distribution of cylinders 5 (15) must in any case be symmetric with respect to the rotor 1 (11). Number of cylinders 5 (15) only depends on the dimension of the disc 1 (11), so that it is possible realising a large ray disc 1 (11), with a longer arm on which n cylinders 5 (15) will act.

It must be noted that disc 1 (11) ray has no effect on the dimensions of the cylinder 5 (15)-piston 4 (14) group, since the two components are not linked to a fixed point, being thus possible that the cylinder 5 (15)-piston 4 (14) groups are realised with reduced mass dimensions, instead acting on a long rotation arm, thus creating a high momentum with large power, requiring a lower amount of fuel.

Figure 5:
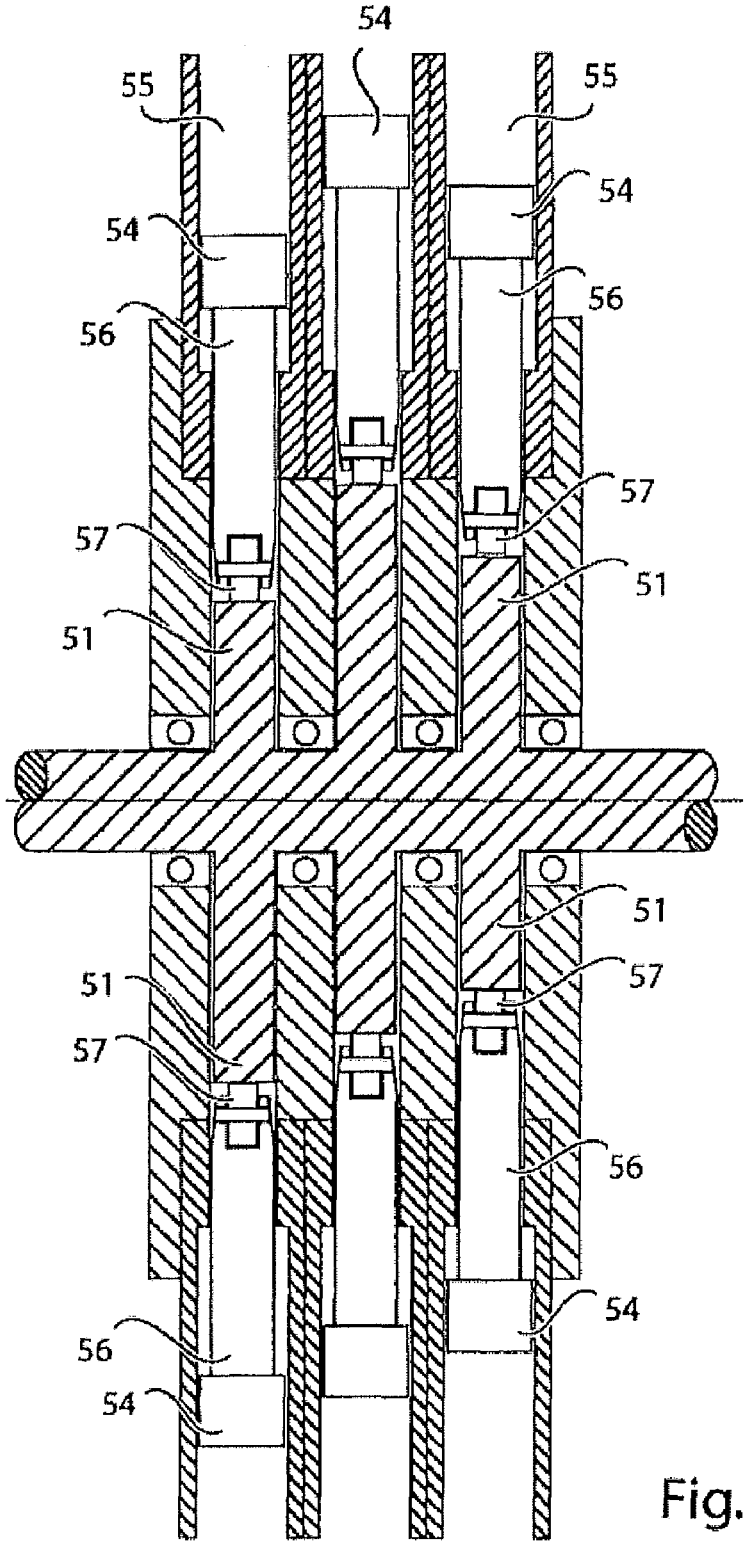
FIG. 5 schematically shows a cross-section of a fifth embodiment of an engine according to the invention.

Coming now to observe FIG. 5 of the enclosed drawings, it is shown an embodiment of the motor according to the invention providing a plurality of rotor discs 51 and cylinders 55 combined each other.

As it can be noted from the enclosed FIG. 5, it is possible mounting a combination of different groups along a single axis 58, thus creating a large power engine, with reduced mass and dimension and with a reduced consumption of fuel.

Figure 6:
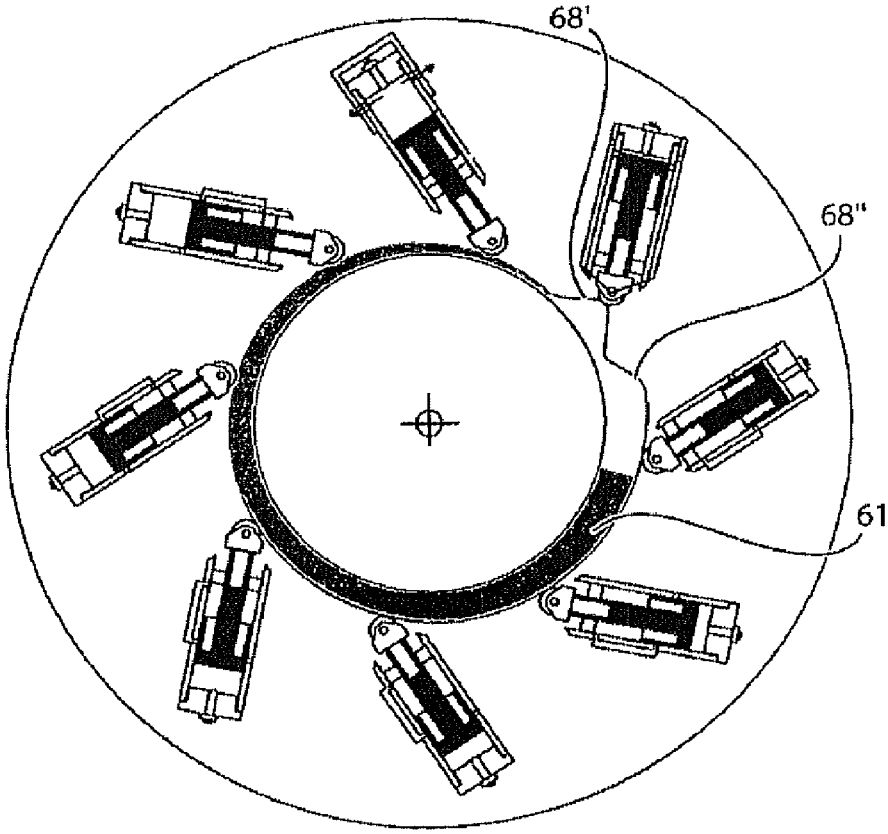
FIG. 6 is a schematic plan view of a four-stroke engine with the system according to the present invention.

An embodiment of an engine according to the invention is shown FIG. 6 realised for a four-stroke engine. It can be noted that the profile of rotor 61 has a double ramp 68', 68", for the intake and compression phases of the four-stoke cycle.

Figure 7:
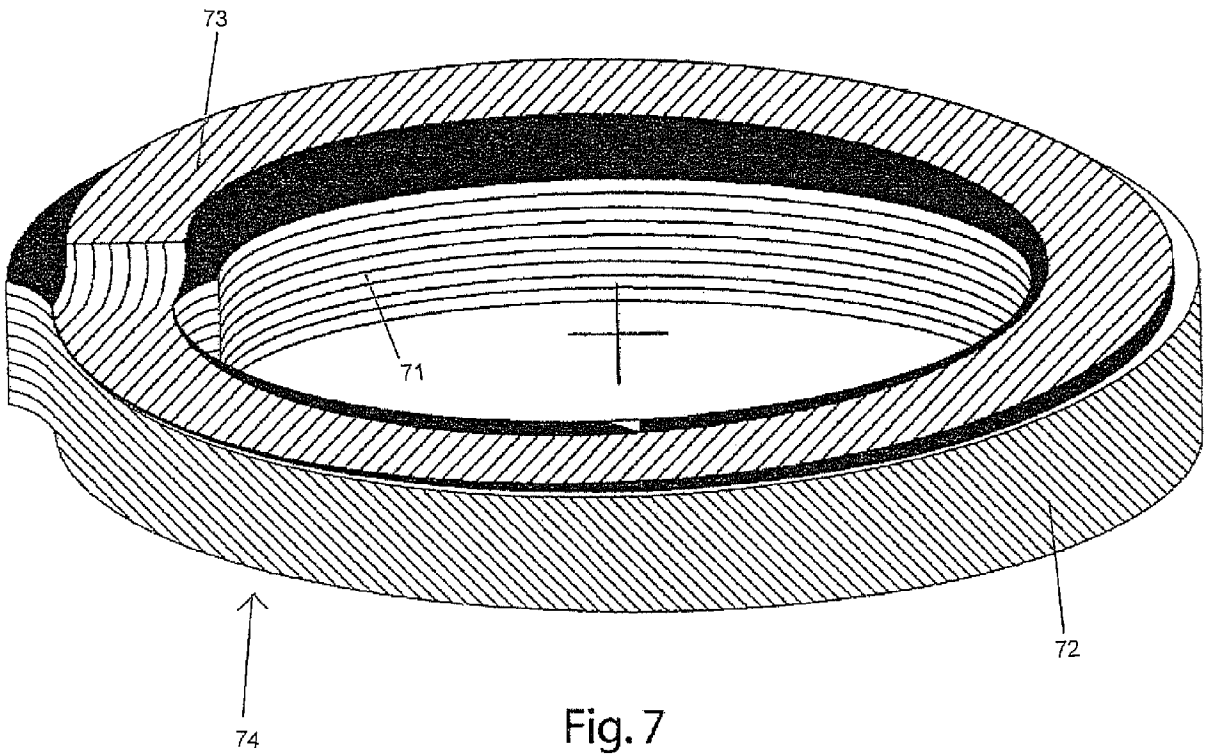
FIG. 7 shows a profile of a rotor according to the invention, with a profile along the three surfaces, respectively on the outer lateral surface, on the inner lateral surface and on the upper surface.

Finally, it can be noted from FIG. 7 that the spiral profile can be realised on more than one surface of the rotor 71, thus obtaining a very valid and complex engine. As shown in FIG. 7, there is an inner surface 71, an outer surface 72, an upper surface 73 and a lower surface 74.

Cylinder inclination angle (reference position) ensures the realisation of the maximum spiral rotation momentum. Moving away the wheel (when the piston exits from the cylinder) the normal force greatly increases, reaching the maximum value in the position outside the piston. Increasing the inclination of the cylinder, the quick increase of the normal force value is reduced during extraction of piston and in this way also the torque of the piston critic section.

Practically, it is necessary that increasing the inclination of the cylinder, the torque value in the piston critic section is reached, ensuring the wished duration of the piston and the "not disturbed" operation of the curvilinear mechanism.

Piston stroke values, as well those of the reaction forces, of the normal forces and their momentum are given by tables and diagrams by which it is possible individuating the value variations. Spiral rotation in the direction opposite with respect to the motion direction of the piston is demonstrated by the position of the normal force that, for the whole duration of the piston motion, creates a torque about the spiral shaped disc axis.

Only the resistances in the cylinder-piston system are taken into consideration during the studies. Other resistances of the mechanism are not taken into consideration since they are not important. When analysing the results, after having chosen the optimum inclination of the cylinder, it would be necessary taking care to the optimisation of the spiral curve of the disc in correspondence of the zone of passage from the minimum to the maximum ray, in order to prevent shocks during the operation thus promoting a longer lasting of the mechanism.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. An improved system for transformation of rectilinear motion into curvilinear motion, or vice versa, in an internal combustion engine, said system comprising a rotor element and a stator element, one of said rotor element and stator element having a closed spiral profile, said spiral profile having a continuous curvilinear portion for at least 270° for an expansion phase of the engine, and a ramp portion joining the ends of said continuous curvilinear portion for other phases of an engine cycle.

2. The system for transformation of rectilinear motion into curvilinear motion, or vice versa, according to claim 1, wherein said spiral profile is realised on the rotor element.

3. The system for transformation of rectilinear motion into curvilinear motion, or vice versa, according to claim 1, wherein said continuous curvilinear portion extends for about 300°.

4. The system for transformation of rectilinear motion into curvilinear motion, or vice versa, according to claim 1, wherein said profile is realised on the outer surface and/or on the inner surface of the rotor element.

5. The system for transformation of rectilinear motion into curvilinear motion, or vice versa, according to claim 1, wherein said profile is provided on the upper surface and/or lower surface of the rotor element.

6. The system for transformation of rectilinear motion into curvilinear motion, or vice versa, according to claim 1, wherein a rolling means operates, with the lowest possible friction, coupled at the end of the rod of a piston, said piston acting within a cylinder.

7. The system for transformation of rectilinear motion into curvilinear motion, or vice versa, according to claim 1, wherein a plurality of sliding or rolling means-piston-cylinder assemblies acts on said rotor element.

8. The system for transformation of rectilinear motion into curvilinear motion, or vice versa, according to claim 1, wherein a plurality of rotors, parallel each other, is provided.

9. The system for transformation of rectilinear motion into curvilinear motion, or vice versa, according to claim 1, wherein said rotor is provided inside a cylinder-supporting block.

10. The system for transformation of rectilinear motion into curvilinear motion, or vice versa, according to claim 1, wherein said rolling means-piston-cylinder assemblies are provided either inside or outside a cylinder-supporting block.

11. The system for transformation of rectilinear motion into curvilinear motion, or vice versa, according to claim 1, wherein said rotor is provided outside a cylinder-supporting block.

12. The system for transformation of rectilinear motion into curvilinear motion, or vice versa, according to claim 1, wherein the continuous curvilinear portion extends for 340°-345° for two stroke engines.

* * * * *